United States Patent [19]

Voltmer

[11] 4,366,023

[45] Dec. 28, 1982

[54] MECHANISM FOR APPLYING LABELS AND THE LIKE

[75] Inventor: Helmut Voltmer, Park Ridge, N.J.

[73] Assignee: NJM, Inc., Fairfield, N.J.

[21] Appl. No.: 300,054

[22] Filed: Sep. 8, 1981

[51] Int. Cl.[3] ..... B44C 1/00

[52] U.S. Cl. ..... 156/542; 156/361; 156/363; 156/584

[58] Field of Search ..... 156/542, 584, 361-363, 156/571, 572, DIG. 31; 271/90, 107, 112, 26 R, 100

[56] References Cited

U.S. PATENT DOCUMENTS

| | | | |
|---|---|---|---|
| 3,682,743 | 8/1972 | Cleary et al. | 156/584 X |
| 3,997,384 | 12/1976 | Kuring | 156/362 X |
| 4,276,112 | 6/1981 | French et al. | 156/542 X |

*Primary Examiner*—David A. Simmons
*Attorney, Agent, or Firm*—John J. Hart

[57] ABSTRACT

The mechanism comprises a pressure sensitive label dispenser for delivering successively pressure sensitive labels from a backing sheet to a label applying station. At the applying station is a mouthpiece having one longitudinal side edge arranged to be transversely disposed across the path of feed of the backing strip and having a lower perforated label carrying surface of less width than the label to be carried thereby. Mounted on the other longitudinal side edge of the mouthpiece is an applying roll. The mouthpiece forms a part of a unit which is fastened to the label dispenser so that a label discharged therefrom moves across the label carrying surface and comes to rest with its advancing edge portion positioned beneath the applying roll. A tubular shaft which also communicates with the mouthpiece to provide suction at its label carrying surface supports the mouthpiece for pivotal movement about its one longitudinal side edge. The shaft has affixed thereto a straight lever, to one arm of which, is connected a solenoid which is energized by electronic means actuated by register marks on a rapidly moving web or by objects carried by a rapidly moving conveyor to pivot the mouthpiece down to cause the applying roll to press the advancing edge portion of the label into adhered relation on an article area moving rapidly beneath the applying station. Means are connected to the other arm of the straight lever to restore the mouthpiece to its label securing position as soon as the label has been applied to the rapidly moving label area. Means are provided to stop the advancement of the backing sheet each time a label is delivered to the applying station. The electronic means for actuating the mouthpiece and its applying roll to apply a label to an article area also restarts the advancement of the backing label so that a succeeding label is fed to the mouthpiece as the previously held label is being stripped therefrom. The unit comprising the mouthpiece, the applying roller, means for pivoting the same to apply a label and means for restoring the mouthpiece for normal label receiving position can be installed in any high speed pressure sensitive label dispenser that can maintain accurate step-by-step movement. Such a dispenser however would need to be modified to practice the purposes of this invention.

2 Claims, 5 Drawing Figures

MECHANISM FOR APPLYING LABELS AND THE LIKE

THE INVENTION

This invention relates to mechanism for successively applying pressure sensitive adhesive coated labels, medallions, coupons, and the like, hereinafter collectively referred to as "labels", to articles moving along a given path. The articles may comprise a continuously moving web of material in strip form, or a continuously moving line of separate objects.

The invention particularly relates to a mechanism which is especially advantageous for the application of pressure sensitive labels supplied by any high speed pressure sensitive label dispenser that can maintain accurate step-by-step movement of the continuous backing web on which the labels are mounted.

The principal object of the invention is to provide an improved mechanism capable of accurately placing within ±1/32 inch and adhering pressure sensitive adhesive labels to successively spaced desired areas moving continuously along a given path at approximately 600 feet per minute.

Another object of the invention is to provide an improved mechanism capable of accurately placing and adhering pressure sensitive adhesive labels to desired areas on a continuous web of material, or on generally flat surfaces provided by a line of objects moving past a given station at speeds of from 500 to 700 web areas or object surfaces per minute.

A further object of the invention is to provide an improved mechanism which can be mounted on any known high speed pressure sensitive label dispenser that maintains accurate step-by-step movement, and which is capable of accurately placing and adhering pressure sensitive labels successively released from a backing web by such dispenser onto successively spaced desired areas moving past the place of release of such labels by the dispenser at high speed.

Other objects of the invention, as well as the features of novelty thereof, will become apparent from a perusal of the following description when read in connection with the accompanying drawings, in which FIG. 1 is a partial schematic view of a pressure sensitive label dispenser embodying the invention;

Figure 1:
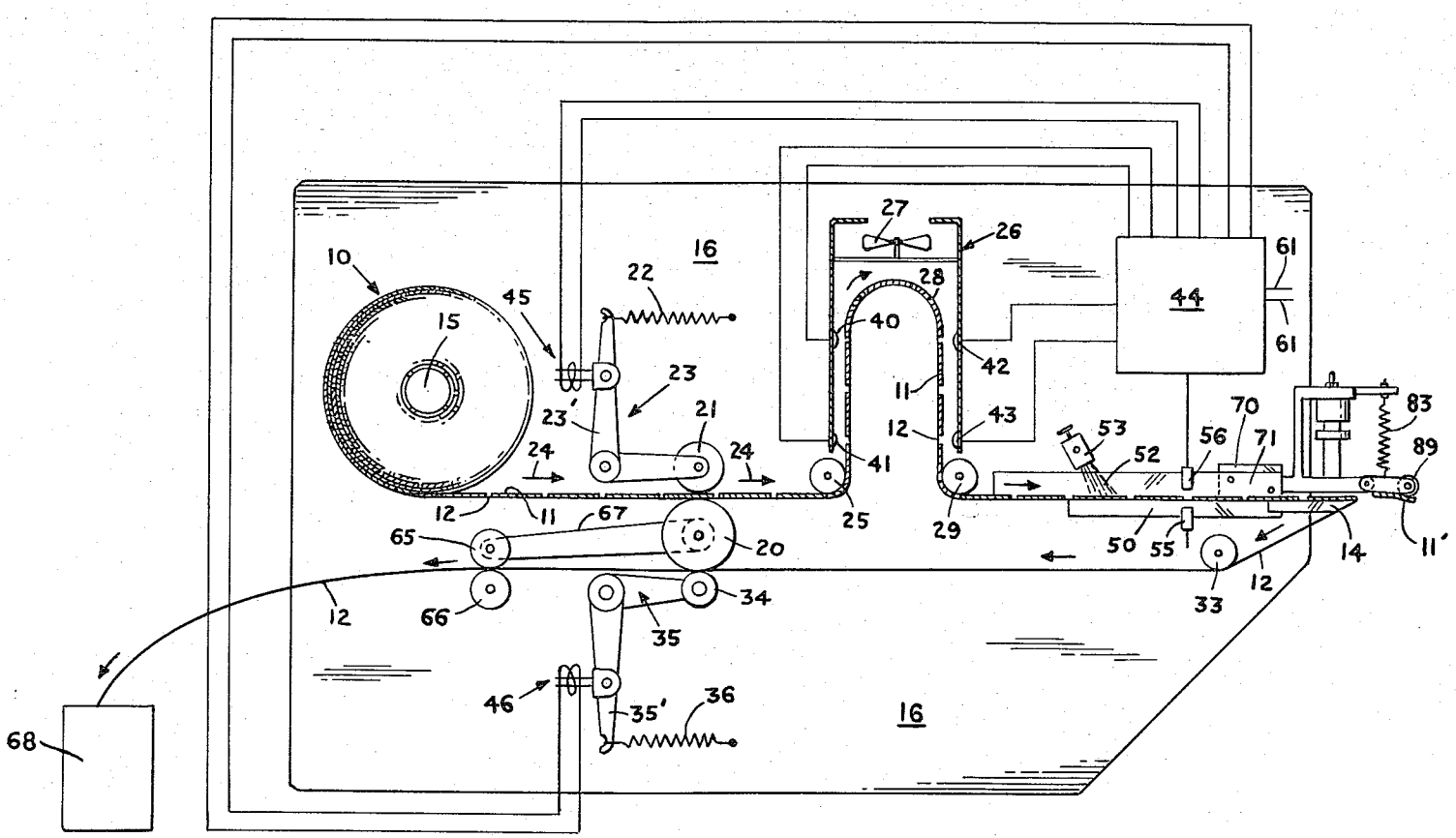
Figure 3:
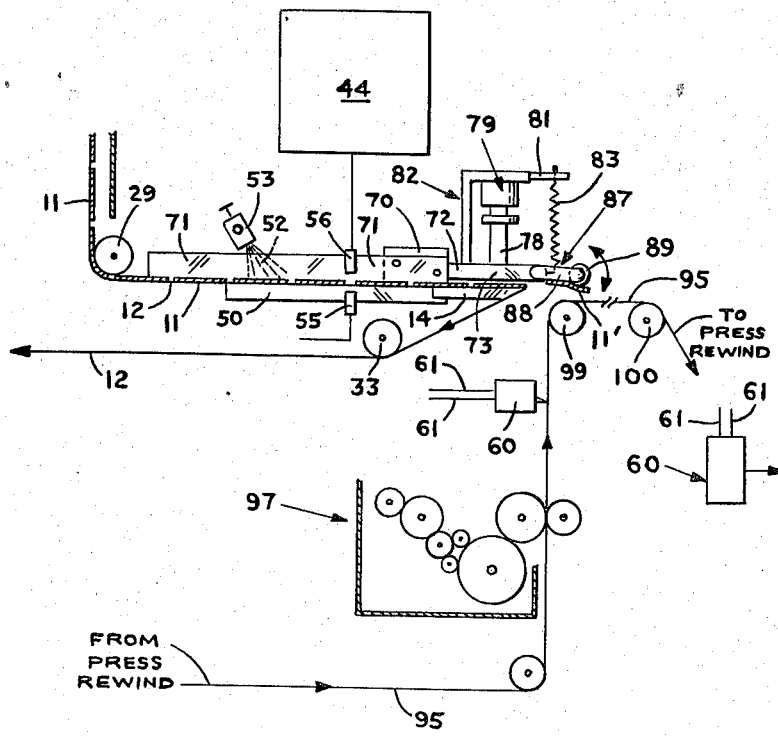
FIG. 3 is a partial schematic view of the dispenser shown in FIG. 1 and showing the applicator mechanism positioned thereon to apply freed labels to a moving printed web.
Figure 5:
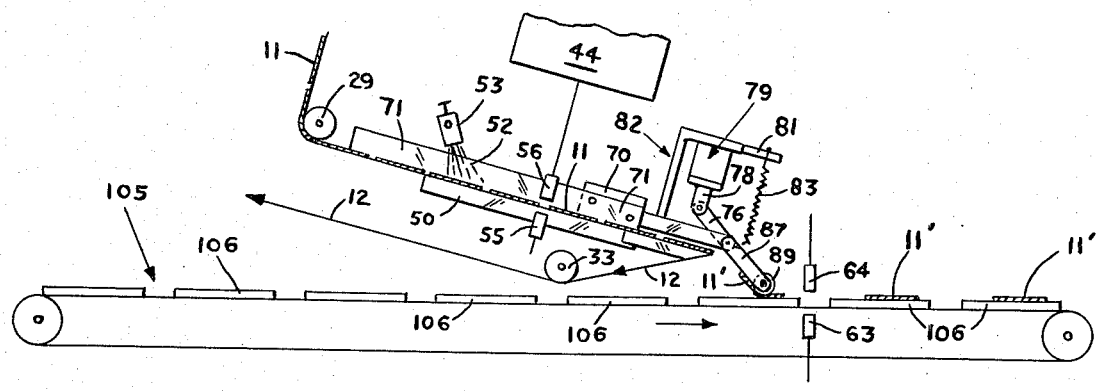
FIG. 5 is a partial schematic view of the dispenser shown in FIG. 1 and showing the applicator mechanism arranged thereon to apply successively freed labels to objects carried by a rapidly moving conveyor.

Reference is now made to FIG. 1 of the drawings, which shows by way of example a form of pressure sensitive label dispenser embodying the invention that may be utilized to apply freed pressure sensitive labels to a moving printed web as shown in FIG. 3, or to a moving line of objects as shown in FIG. 5. The dispenser includes a supply roll 10 of pressure sensitive labels 11 which as previously pointed out may be regular article labels, medallions, coupons, and the like, provided on paper, film, foil or fabric. As is customary, the pressure sensitive labels 11 are mounted in a continuous line on a backing web 12 of paper material that embodies a material enabling the progressive release of the labels when the web 12 is bent about the sharp end of a peel plate of known construction. The supply roll 10 is mounted on a support shaft 15 supported by a frame plate 16 of the dispenser. The roll 10 is unwound and the web 12 is pulled from the roll by a continuously moving roll 20 and a roll 21 intermittently contacting the roll 20. The roll 20 is continuously driven by a gear head motor (not shown) mounted on the frame plate 16. The roll 21 is biased into contact with the roll 20 by a spring 22 fixed at one end to the plate 16 and connected at the other end to one arm 23' of a bell crank lever 23 pivotally mounted on a shaft secured to the plate 16. The other arm of lever 23 carries the roll 21. The engagement of roll 21 with roll 20 carries the backing web 12 to move from the supply roll 10 in the direction shown by the arrows 24 toward a guide bar 25 located at the lower open end of a box-like column 26. At the top of column 26 is provided a small exhaust fan 27 capable of drawing the web passing the guide bar 25 up into the column 26 to form an upwardly extending loop 28.

The leg of the loop discharging from the column 26 passes around a second guide bar 29 located at the lower end of the column 26. The backing web is drawn from the loop 28 around such guide bar 29, the sharp end of the peel plate 14 and under a spacing guide bar 33 when a roll 34, diametrically positioned relative to the roll 21, presses against the underside of the continuously rotatable roll 20. The roll 34 is mounted on one arm of a pivotally mounted bell crank lever 35, to the other arm 35' of which is connected one end of a spring 36 whose other end is secured to the frame plate 16. The tension of spring 36 tends to maintain the roll 34 in contact with the roll 20.

The column 26 carries on one of its side walls two vertically spaced sources of light 40 and 41 whose beams project on electronic light sensors 42 and 43, respectively, mounted on an opposing side wall of the column. The sensors 42 and 43 are electrically connected to an electronic chassis 44 of known construction. Also electrically connected to the electronic chassis 44 are two solenoids 45 and 46. The solenoid 45 is so connected to the arm 23' of the lever 23 that when it is energized it pivots the lever 23 to withdraw the roll 21 from contact with the roll 20 against the tension of the spring 22. The solenoid 46 is so connected to the arm 35' of the lever 35 that when it is energized it pivots the lever 35 to withdraw the roll 34 from contact with the roll 20 against the tension of the spring 36.

It will be understood from the foregoing that when the loop 28 is fed by the rolls 20, 21 to the point where it intersects the beam of light passing from the source 40 to the sensor 42, the latter sends a signal to the electronic chassis 44. This signal causes the chassis 44 to activate the solenoid 45 to pivot the lever 23 in a counterclockwise direction against the tension of spring 22 and thereby lift the roll 21 out of engagement with the roll 20. Thus the feed of web from the roll 10 to the loop 28 is stopped. As the web continues to be taken from the loop 28 by the coaction of the rolls 20 and 34, the loop 28 depletes until it permits the passage of light from light source 41 to the sensor 43. When this occurs the sensor 43 signals the chassis 44 to deenergize the solenoid 45 and permit the spring 22 to rotate the lever 23 in a clockwise direction until the roll 21 reengages the roll 20 thereby causing the feeding of more web into the loop 28.

During the feed of the web 12 from the loop 28 by the coaction of the rolls 20, 34, the web moves over an elongated support plate 50 which has connected to its downstream end the sharp radiused peel plate 14. Associated with the support plate 50 is a resilient squeezing member arranged to grip the web against the plate 50 and thereby create a tension in the web as it is pulled by the rolls 20, 34 about the sharp end of the peel plate 14. As is shown in FIG. 1 of the drawings, the resilient squeezing member may comprise a brush 52 mounted on a stud 53 supported by the frame plate 16. As the web is being drawn under tension around the sharp radius of the peel plate 14, the labels 11 which are releasably fastened to the coated web 12 will progressively peel from the web until they are entirely free therefrom, as illustrated by the label designated 11' in FIG. 1 of the drawings.

Associated with the support plate 50 between the resilient squeezing member 52 and the sharp end of the peel plate 14 is a light source 55 arranged to project its beam upwardly through the backing web 12 towards a light sensor 56 located above the web and electrically connected to the electronic chassis 44. The backing web 12 is rendered translucent by the releasable material provided on it, thereby permitting the passage of some light from the source 55 to the sensor 56. However, the areas of the web which are covered by the labels 11 are rendered opaque, or at least considerably less translucent than the areas of the web between the labels. Thus when the front or advancing edge of a label 11 moves into interference with the light beam from source 55, the light is either blocked from reaching the sensor 56, or considerably reduced in intensity. This change in the intensity of light reaching the sensor 56 causes the latter to send a signal to the chassis 44 which in turn energizes the solenoid 46. The energized solenoid 46 pulls on the arm 35' of the lever 35, overcoming the tension of the spring 36 and causing the lever 35 to rotate in a clockwise direction about its pivot to disengage the roll 34 from the roll 20. Upon such disengagement of the rolls 20, 34, the backing web 12 will immediately stop moving due to the resistance to such movement created by the clamping action of the device 52. The light source 55 and the sensor 56 are adjustably mounted on the support 50 so that they can be moved as a unit along the path of movement of the web. Thus, it is possible to adjust the stopping position of the web so that it occurs just as a label 11' is peeled off the web. In other words, the adjustment may be such that the trailing edge of the terminal label will have just been released from the backing strip at the time that the web stops its forward motion, as is illustrated by the label 11' in FIG. 1 of the drawings.

Figure 4:
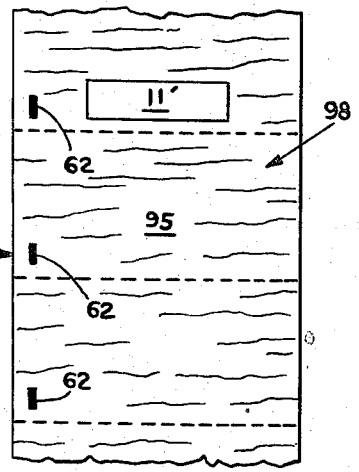
FIG. 4 is a plan view of a portion of the printed web shown in FIG. 3.

The movement of the backing web 12 may be resumed by an external switch of known construction which is electrically connected to the chassis 44 so that when it is actuated it directs the chassis 44 to deenergize the solenoid 46, thereby enabling the spring 36 to pivot the lever 35 to return the roll 34 into operative engagement with the roll 20. The external switch may be a known electronic scanning device 60 electrically connected by wires 61, 61 to the chassis 44 (compare FIGS. 1 and 4) and comprising a light source and a sensor arranged to be activated by register marks 62 provided on a web of printed matter passing by this electronic switch as shown in FIG. 4, or by objects passing between them, as is illustrated by the light source 63 and sensor 64 shown in FIG. 5 of the drawings. After the backing web 12 passes between the register draw rolls 20, 34 it is fed between two lightly touching rolls 65, 66 which are driven by a belt 67 connecting the continuously driven roll 20 with roll 65. The rolls 65, 66 serve to remove the label depleted portions of the backing strip 12 from the register roll area and feed it to a rewinder, or to a place where it can be pushed into a disposal container 68, or into the intake end of a central vacuum cleaning system.

Figure 2:
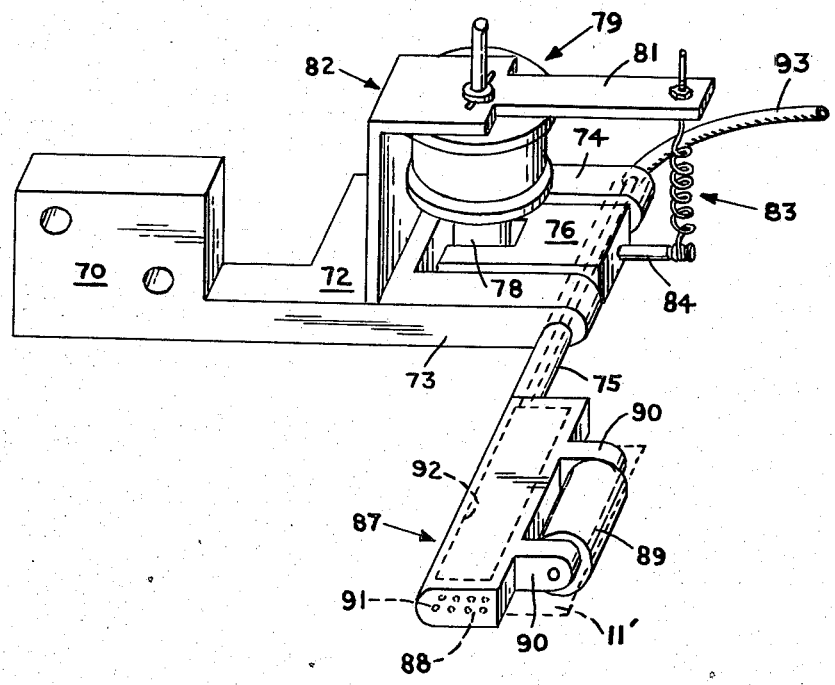
FIG. 2 is a perspective schematic view of the applicator mechanism mounted on the dispenser for applying the freed pressure sensitive labels to the desired article areas.

The application mechanism for applying the labels 11' freed from the backing tape 12 to the desired article areas is shown in FIG. 2 of the drawings. As has been previously indicated this applicator mechanism is a unitary device which may be mounted on any high speed pressure sensitive label dispenser that can maintain accurate step-by-step movement, such as the pressure sensitive label dispenser shown in FIG. 1 and above described. The applicator unit comprises an inner end, vertically disposed, as viewed in FIGS. 2 and 3, attachment block or portion 70 which may be bolted to a support provided in the dispenser, such as the bar 71 shown in FIGS. 1 and 3 of the drawings. The bar 71 is vertically disposed with relation to and adjustably mounted on the support plate 50 to one side of the path of the backing tape 12 and the outer end thereof to which the attachment block 70 of the applicator unit is attached, is located adjacent to the inner end of the peel plate 14. Integral with the attachment block 70 is an outwardly extending plate 72 disposed at right angles to the attachment block 70 and with one side aligned with the front face of the block 70, as viewed in FIG. 2 so as to be located to one side of and in parallel relation to the path of the backing web 12. The plate 72 extends inwardly from such one side so as to be located on the dispenser between such web path and the frame plate 16 and slightly above the former. Thus the plate 72 will be arranged on the dispenser in offset parallel relation to the path of the backing web 12. The plate 72 is formed to provide a pair of spaced outwardly disposed extensions 73, 74, the outer ends of which serve as bearing supports for a transverse shaft 75 having a front end projecting beyond the said one side of the plate 72. Secured to the portion of the shaft 75 located between the bearing supports 73, 74, is the outer end of a lever 76 in the form of a plate. The lever 76 extends inwardly from the shaft 75 and between the bearing supports or extensions 73, 74 toward the roots of such extensions and is pivotally connected at its inner free end to the core 78 of a solenoid 79. The body of the solenoid containing its coil is secured at its upper end to the horizontal arm 81 of an angular bracket 82 mounted on the plate 72. The bracket arm 81 extends in spaced relation outwardly over the lever 76 and has connected to its outer end one end of a vertically disposed spring 83 which is connected at its lower end to the outer end of a post 84 projecting outwardly from the outer end of the lever 76 to a point beyond the shaft 75. The spring 83 maintains the lever 76 in parallel relation to the extensions 73, 74 when the solenoid 79 is deenergized, compare FIG. 2 with FIG. 1 or 3. When the solenoid 79 is energized it lifts the inner end of the lever 76 against the tension of the spring 83, causing the lever 76 to pivot upwardly about the longitudinal axis of the shaft 75. The solenoid is electrically connected to the electronic chassis 44 and its energization is controlled by the scanning device 60 in a manner which will hereinafter become more clear.

The forwardly projecting portion of the shaft 75 has connected to its forward end an elongated vacuum mouthpiece 87 which as a whole is located at the label applying station and positioned so as to be adjacently above the peel plate 14 and extending forwardly from the shaft 75 across the just in front of the sharp end of the peel plate 14. The location of the mouthpiece 87 relative to the peel plate 14 is such that as the terminal label 11' is progressively peeled from the backing web 12 by the peel plate 14, the label 11' will slide across the lower face 88 of the mouthpiece 87. The dimensions of the lower face 88 of the mouthpiece 87 are such that when the label 11' is entirely freed from the backing web 12 the vacuum created at such lower face will be such as to hold the freed label 11' in suspension with its leading edge portion underlying an applying roll 89, as indicated in FIGS. 2 and 3 of the drawings. The roll 89 is rotatably supported by two spaced bearing lugs 90, 90 projecting from the outer longitudinal edge of the mouthpiece 87. The lower face 88 of the mouthpiece 87 is provided with a plurality of vacuum holes 91 which bring the face into communication with a vacuum chamber 92 formed in the body of the mouthpiece 87. The shaft 75 is a tubular shaft which communicates at its forward end with the vacuum chamber 92. At its other or rear end, the shaft has connected thereto by an air tight seal a hose 93 which is connected to a vacuum pump, not shown.

The above described applying or applicator mechanism is shown in FIG. 3 of the drawings attached to a pressure sensitive label dispenser similar to the one above described and shown in FIG. 1 and arranged on a printing press of known construction to place labels on a printed web 95 while it is in the press being printed. Thus, the application of the labels to the web 95 is being done substantially simultaneously with the printing of the web without sacrificing the quality or the speed of printing. As previously indicated, the applicator is so arranged with respect to the peel-point nose piece of the peel plate 14 that, the lower face 88 of the mouthpiece 87 of the applicator is so close to the plane of the terminal label 11' being freed from the backing web 12 by the peel plate that as the label 11' is being progressively peeled from the backing web it will slide across the lower face 88 of the mouthpiece. The vacuum furnished at the lower face 88 is such that the label 11' will be held in slidable contact with such face 88 as it is progressively peeling off the backing web. When the label 11' has been completely peeled from the backing web, the vacuum at the mouthpiece face 88 will stop the movement of the freed label 11' and hold it over the moving printed web 95 with the leading edge portion of the label under the applying roll 89.

As shown in FIG. 3, the web 95 in its rapid movement moves from a press unwind (not shown), through a printing press color station 97, past the scanning device 60 and over a guide roll 99 located at the label applying station adjacently below the freed label 11' held by the mouthpiece 87. The web 95 passes from the roll 99 in a horizontal direction to a spaced guide roll 100 and, from thence to the press rewind (not shown). As previously indicated the web 95 is provided with printed register marks 62 which during the printing operation have been printed on the web in register with the areas 98 which have printed on the web and locating the exact area on the web to which a label 11' is to be applied. The register marks 62 may be either a part of the material printed in the areas 98 of the web 95, or as is shown in FIG. 4 of the drawings, be printed along the edge of the web 95 where they can be slit off as the printed web is rewound or fan folded. As the printed register marks 62 in the travel of the web 95 pass the reflective scanning device 60, the contrast in color caused by the register marks 62 will activate the scanning device 60 to send a signal to the electronic chassis 44. Upon receipt of such signal, the chassis 44 simultaneously energizes the solenoids 79 in FIGS. 2 and 3, and 46 in FIG. 1. As previously described the energizing of solenoid 46 starts the feed of the backing web 12 which has been stopped by the action of the scanning means composed of the light source 55 and the sensor 56 upon the complete discharge of the label 11' from the backing web 12. The energizing of solenoid 79 causes the lever 76 to pivot upwardly in a clockwise direction about the longitudinal axis of shaft 75 from the position shown in FIGS. 2 and 3, to the position shown in FIG. 5. Such pivotal movement of the lever 76 rotates the shaft 75 in a similar direction to cause the suction mouthpiece 87 to pivot downwardly about the longitudinal axis of shaft 75 to bring the applying roll 89 downwardly and impinge the leading edge portion of the label 11' carried by the mouthpiece on the portion 98 of the printed web passing over the guide roll 99. The extreme tack of the pressure sensitive adhesive on the label causes it to immediately bond to the rapidly moving web 95 which thereupon strips the remainder of the label from the mouthpiece 87. The solenoid is energized only momentarily by the chassis 44, just sufficiently long to cause the applying roll 89 to engage the leading edge portion of the label 11' with the printed web 95. Thereupon, the spring 83 immediately rotates the shaft 75 to return the lever 76, the mouthpiece 87 and the applying roll 89 to their deenergized positions, as shown in FIGS. 2 and 3 of the drawings.

It will be understood from the foregoing that the label 11' is being applied to the printed web and moved away from the mouthpiece 87 at great speed, while the succeeding pressure sensitive label is moving from the backing web 12 to the mouthpiece. By the time such succeeding label has moved into sliding engagement with the mouthpiece 87, the latter and the applying roll 89 are out of contact with the printed web and substantially in the position shown in FIG. 3 of the drawings. The aforesaid results are accomplished by the actions of the scanning means composed of the light source 55 and the sensor 56. As has been previously explained the light source 55 and sensor 56 act to cause the chassis 44 to energize the solenoid 46 to stop the feeding movement of the backing web 12 immediately upon the blockage of the beam from the light source 55 by the advancing end of a selected succeeding label 11 located downstream from the sharp edge of the peel plate 14. This stoppage of the backing web occurs just as the trailing edge of the terminal label 11' has been released from the backing web or strip 12 and is being held in suspended condition at the label applying station by the mouthpiece 87. When the scanning device 60 is activated by a register mark 62 on the printed web 95, the chassis 44 is directed both to deenergize the solenoid 46 and to energize the solenoid 79, thereby restarting the feed of the backing web 12 and applying the leading end portion of the label 11' held by the mouthpiece 87 to the printed web 95. As previously mentioned the solenoid 79 is only momentarily energized to accomplish the application of the leading end portion of the label 11' by the applying roll 89 associated with the mouthpiece 87 and to maintain the pressing action of the applying roll 89 on the label 11' as it is being stripped from the mouthpiece 87 by the printed web portion 98 to which the label has been adhered. As soon as such application is made, the spring 83 comes into action to restore the mouthpiece to its starting position. It will be understood that the aforesaid applying action is extremely rapid for the series of printed web portions 98 are moving past the mouthpiece 87 at a rate of approximately 700 per minute. The degree of accuracy of such applications is extremely high, of the order of $\pm 1/32$ of an inch, because of the close coordination of the scanning device composed of the light source 55 and sensor 56 and the scanning device 60 and means controlling the operations of such scanning means and the means controlled thereby.

FIG. 5 shows how the pressure sensitive label dispenser and the attached applicator mechanism may be arranged relative to a rapidly moving conveyor carrying articles to be labeled. The conveyor 105 illustrated is moving objects such as cereal box blanks 106 at speeds of 500–600 per minute under the dispenser-applicator. In the arrangement illustrated, the dispenser-applicator is disposed in angular relation above the conveyor 105 and is shown in the act of applying to one of the cereal box blanks a label 11' which has just been peeled from the backing web 12 and is carried by the mouthpiece 87. As shown, the solenoid 79 has been momentarily energized to pivot the lever 76 upwardly thus causing the shaft 75 to rotate the mouthpiece 87 downwardly so that the applying roll 89 presses the leading edge portion of the label carried by the mouthpiece against the top surface of the box blank to which such label edge portion is instantly bonded by the tacky pressure sensitive adhesive coating the underside of the label. Almost instantly thereafter the label will be stripped off the mouthpiece and applied by the roll 89 to the box blank as the latter continues its rapid movement. The dispenser-applicator will then continue operating in the manner previously described with relation to the printing press shown in FIG. 3 to feed a succeeding label to the mouthpiece 87 for application to the next box blank. In the arrangement shown in FIG. 5, the light source 63 and sensor 64, which are directly connected to the chassis 44, are arranged at a given place so that the light beam from the source 63 is projected through the run of the conveyor 105 carrying the box blanks 106. The conveyor is constructed so that a portion at least of the light beam reaches the sensor 64 through those portions of the top run of the conveyor not bearing the box blanks. When the front edge of a box blank on the upper conveyor run moves into interference with the light beam to block its passage to the sensor 64, sensor 64 will send a signal to the chassis 44 causing the energization of the solenoids 79 (FIGS. 2 and 3) and 46 (FIG. 1) to cause the feed of the backing web 12 to be restored and the application of a label 11' carried by the mouthpiece 87 to a box blank moving past the applying station as previously described. The place of light source 63 and sensor 64 is selected so that when the front edge of a box blank blocks the beam from the light source the mouthpiece 87 and roller 89 will impress a label 11' on a given selected area of the box blank.

While I have hereinabove described and illustrated in the drawings preferred embodiments of my invention, it will be apparent to those skilled in the art that modifications may be made therein without departing from the spirit of the invention of the scope of the appended claims.

What is claimed is:

1. An applicator unit for attachment to a pressure sensitive label dispenser arranged to supply successive detached pressure sensitive labels arranged on a backing strip to an article applying station, said applicator unit comprising a mounting portion adapted to be fastened to the label dispenser, a plate extending from said mounting portion and centrally cut out to provide a pair of longitudinally extending extensions spaced by an open ended slot, a tubular shaft rotatably mounted on the outer free ends of said extensions, a straight lever secured to said shaft between said extensions and having one arm located in said open ended slot and the other arm projecting outwardly from said tubular shaft, a suction mouthpiece having one longitudinal side edge portion connected to one end of said shaft and having an interior suction chamber in communication with a lower perforated label carrying surface, the interior of said tubular shaft being in communication with said suction chamber and connected at its other end to a source of suction, label pressing means on the other longitudinal side edge portion of said mouthpiece for engaging the advancing edge portion of a label discharged by said label dispenser, the unit being so positioned on the dispenser that successive labels supplied by the latter will be fed across said label carrying surface and supported by the vacuum furnished through the latter with the advancing edge portions of such labels positioned beneath said pressing means, a solenoid connected to the inner end of said one lever arm and operable when energized to raise such lever arm about the longitudinal axis of said shaft and thereby to pivot said mouthpiece downwardly about said longitudinal axis to cause said pressing means to adhere the front edge portion of the label carried by said mouthpiece to an article area, and a spring connected to the outer end of said other lever arm for returning said mouthpiece and said lever to their starting positions.

2. The combination of means for successively supplying pressure sensitive labels to an article applying station, including means for advancing a backing web carrying a series of pressure sensitive labels toward said applying station and means for successively separating from said backing web the labels to be delivered to said applying station, means for stopping the operation of said advancing means each time a separated label is delivered to the applying station, means for rapidly moving a series of article areas past said applying station, means located at the applying station for successively applying the separated labels delivered thereat to said article areas, said applying means comprising shaft supporting means, a tubular shaft rotatably supported by said shaft supporting means, a lever secured to said shaft and having one arm projecting in one direction from said shaft, said lever having another arm projecting in another direction from said shaft, a suction mouthpiece connected to one end of said shaft and having an interior suction chamber in communication with a lower perforated label carrying surface, the interior of said tubular shaft being in communication with said suction chamber and connected at its outer end to a source of suction, label pressing means carried by said mouthpiece for engaging the advancing edge portion of a label delivered to said applying station, said mouthpiece being so positioned that successive labels delivered to said station will be fed across said label carrying surface and supported by the vacuum furnished through the latter with the advancing edge portions of such labels positioned beneath said pressing means, a solenoid connected to said one lever arm and operable when energized to move said lever arm about the longitudinal axis of said shaft and thereby to pivot said mouthpiece toward an article area and cause said pressing means to adhere the front edge portion of a label carried by said mouthpiece to such article area, said solenoid maintaining such pressing means in such position until the label is stripped from the mouthpiece by the rapid movement of such article area, and a spring connected to said other lever arm for returning said mouthpiece and said lever to their starting positions after such label has been stripped from said mouthpiece.

* * * * *